US011482771B2

(12) United States Patent
Lampersberger et al.

(10) Patent No.: US 11,482,771 B2
(45) Date of Patent: Oct. 25, 2022

(54) RADIO-FREQUENCY DEVICE WITH RADIO-FREQUENCY CHIP AND WAVEGUIDE STRUCTURE

(71) Applicant: Infineon Technologies AG, Neubiberg (DE)

(72) Inventors: Thomas Lampersberger, Linz (AT); Reinhard Feger, Linz (AT); Markus Josef Lang, Pfarrkirchen (AT); Juergen Minichshofer, Linz (AT); Ernst Seler, Munich (DE); Andreas Stelzer, Linz (AT)

(73) Assignee: Infineon Technologies AG, Neubiberg (DE)

( * ) Notice: Subject to any disclaimer, the term of this patent is extended or adjusted under 35 U.S.C. 154(b) by 17 days.

(21) Appl. No.: 17/248,167

(22) Filed: Jan. 12, 2021

(65) Prior Publication Data

US 2021/0218127 A1 Jul. 15, 2021

(30) Foreign Application Priority Data

Jan. 13, 2020 (DE) ..... 102020100576.8
May 12, 2020 (DE) ..... 102020112787.1

(51) Int. Cl.
*H01Q 1/22* (2006.01)
*H01Q 21/00* (2006.01)
(Continued)

(52) U.S. Cl.
CPC ..... *H01Q 1/2283* (2013.01); *H01Q 5/371* (2015.01); *H01Q 9/0414* (2013.01); *H01Q 21/0037* (2013.01)

(58) Field of Classification Search
CPC ..... H01Q 1/2283; H01Q 5/55; H01Q 13/00; H01Q 13/02; H01Q 13/06; H01Q 13/22;
(Continued)

(56) References Cited

U.S. PATENT DOCUMENTS

2004/0119564 A1* 6/2004 Itoh ..... H01P 5/107 333/208
2015/0364830 A1* 12/2015 Tong ..... H01Q 23/00 342/27
(Continued)

FOREIGN PATENT DOCUMENTS

DE 19813767 A1 10/1998
DE 60107366 T2 12/2005
(Continued)

*Primary Examiner* — Jason Crawford
(74) *Attorney, Agent, or Firm* — Harrity & Harrity, LLP

(57) ABSTRACT

A radio-frequency device comprises a semiconductor package, which comprises a radio-frequency chip and a radio-frequency antenna. The semiconductor package is designed to be mechanically and electrically connected to a circuit board via at least one connecting element of the semiconductor package, with one surface of the semiconductor package facing the circuit board. The radio-frequency device also comprises a waveguide structure oriented in a direction parallel to the surface of the semiconductor package, the radio-frequency antenna being designed for at least one of the following: to emit radiation into the waveguide structure in the direction parallel to the surface of the semiconductor package, or to receive signals via the waveguide structure in the direction parallel to the surface of the semiconductor package.

22 Claims, 7 Drawing Sheets

(51) Int. Cl.
*H01Q 9/04* (2006.01)
*H01Q 5/371* (2015.01)

(58) Field of Classification Search
CPC ..... H01Q 9/04; H01Q 9/0407; H01Q 9/0414; H01Q 21/0006; H01Q 21/0037; H01Q 21/065; H01Q 21/20; H03P 3/16; H01P 5/1022
See application file for complete search history.

(56) References Cited

U.S. PATENT DOCUMENTS

| | | | | |
|---|---|---|---|---|
| 2016/0126637 | A1* | 5/2016 | Uemichi | H01Q 21/0043 343/771 |
| 2016/0301125 | A1* | 10/2016 | Kim | H01Q 1/2283 |
| 2017/0201028 | A1* | 7/2017 | Eberhardt | H01P 3/127 |
| 2018/0267161 | A1* | 9/2018 | Nagaishi | G01S 7/03 |
| 2019/0190142 | A1* | 6/2019 | Nagaishi | H01Q 1/526 |
| 2020/0021002 | A1* | 1/2020 | Wojnowski | H01L 23/66 |
| 2021/0218127 | A1* | 7/2021 | Lampersberger | H01Q 5/371 |

FOREIGN PATENT DOCUMENTS

| | | | |
|---|---|---|---|
| DE | 60208294 | T2 | 8/2006 |
| DE | 102005054233 | A1 | 5/2007 |
| DE | 102016107678 | A1 | 10/2017 |
| DE | 102017122600 | A1 | 3/2019 |
| DE | 112015007202 | T5 | 9/2019 |

* cited by examiner

RADIO-FREQUENCY DEVICE WITH RADIO-FREQUENCY CHIP AND WAVEGUIDE STRUCTURE

CROSS REFERENCE TO RELATED APPLICATION

This application claims priority to German Patent Application No. 102020100576.8, filed on Jan. 13, 2020, and German Patent Application No. 102020112787.1, filed on May 12, 2020, the contents of which are incorporated by reference herein in their entirety.

TECHNICAL FIELD

The present disclosure refers in general to radio frequency (RF) technology. For example, the present disclosure relates to RF devices with an RF chip and waveguide structure.

BACKGROUND

RF devices can be used for automotive safety applications, for example. For example, radar sensors can be used for dead-angle detection, automated speed control, collision avoidance systems, etc. The RF devices can be mounted on a circuit board, which can comprise an expensive RF laminate, among other items. In some RF systems, RF signals can be transmitted between the components on the board using planar waveguides. Both losses and crosstalk can occur between adjacent planar waveguides.

BRIEF DESCRIPTION

Various aspects relate to a radio-frequency device. The radio-frequency device comprises a semiconductor package. The semiconductor package comprises a radio-frequency chip and a radio-frequency antenna, wherein the semiconductor package is designed to be mechanically and electrically connected to a circuit board via at least one connecting element of the semiconductor package, with one surface of the semiconductor package facing the circuit board. The radio-frequency device also comprises a waveguide structure oriented in a direction parallel to the surface of the semiconductor package, the radio-frequency antenna being designed for at least one of the following: to emit radiation into the waveguide structure in the direction parallel to the surface of the semiconductor package, or to receive signals via the waveguide structure in the direction parallel to the surface of the semiconductor package.

Various aspects relate to a method for producing a radio-frequency device. The method comprises producing a semiconductor package. The semiconductor package comprises a radio-frequency chip and a radio-frequency antenna, wherein the semiconductor package is designed to be mechanically and electrically connected to a circuit board via at least one connecting element of the semiconductor package, with one surface of the semiconductor package facing the circuit board. The method also comprises generating a waveguide structure oriented in a direction parallel to the surface of the semiconductor package, the radio-frequency antenna being designed for at least one of the following: to emit radiation into the waveguide structure in the direction parallel to the surface of the semiconductor package, or to receive signals via the waveguide structure in the direction parallel to the surface of the semiconductor package.

DETAILED DESCRIPTION

In the following detailed description, reference is made to the attached drawings in which concrete aspects and implementations are shown for illustrative purposes, in which the disclosure can be implemented in practice. In this respect, directional terms such as "above", "below", "at the front", "at the rear", etc. are used with respect to the orientation of the figures being described. Since the components of the described implementations can be positioned in different orientations, the direction terms can be used for illustrative purposes and are in no way restrictive. Other aspects can be used and structural or logical changes can be made without departing from the idea underlying the present invention. The following detailed description is therefore not to be interpreted in a restrictive sense.

The following text describes, in particular, schematic views of RF devices according to the disclosure. The RF devices may be shown in a general form, in order to describe aspects of the disclosure in qualitative terms. The RF devices can each comprise further aspects, which for the sake of simplicity are not shown in the figures. For example, the respective RF devices may be extended to include any aspects described in connection with other devices or methods according to the disclosure.

Figure 1:
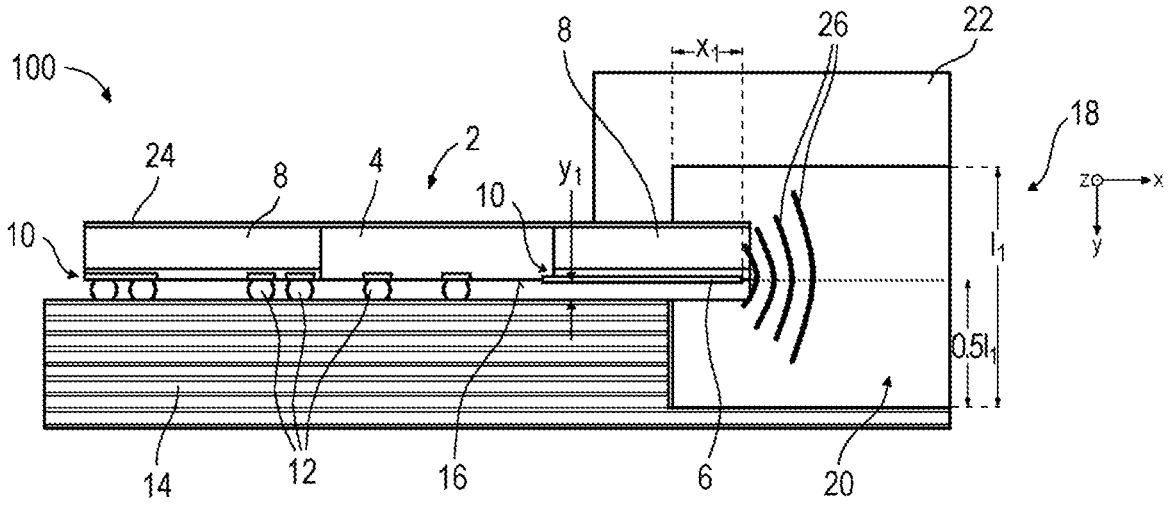
FIG. 1 illustrates a schematic, cross-sectional side view of an RF device 100 according to the disclosure.

The RF device 100 of FIG. 1 can comprise a semiconductor package 2 with an RF semiconductor chip 4 and an RF antenna 6. The semiconductor package 2 can also comprise an encapsulation material 8, a redistribution layer 10, and one or more connecting elements 12. The semiconductor package 2 can be electrically and mechanically connected to a circuit board 14 via the connecting elements 12. The lower surface 16 of the semiconductor package 2 may be facing the circuit board 14 and, in particular, extend parallel to the surface of the circuit board 14, e.g. in the x-direction. The circuit board 14 may or may not be considered as part of the RF device 100. In addition, the RF device 100 can comprise a waveguide structure 18. In the example of FIG. 1, the waveguide structure 18 can have a recess 20 in the circuit board 14 and a waveguide 22 arranged above the recess 20.

The RF chip 4 may contain, in particular, a monolithic microwave integrated circuit (MMIC) or correspond to such a device. The RF chip 4 can operate in different frequency ranges. Accordingly, the RF antenna 6 which is electrically coupled to the RF chip 4 can be designed to emit and/or receive signals with frequencies in these frequency ranges. In one example, the RF chip 4 can operate in a radio-frequency or microwave-frequency range, which can generally range from approximately 10 GHz to approximately 300 GHz. As an example, circuits integrated in the RF chip 4 can operate in a frequency range higher than approximately 10 GHz, and the RF antenna 6 can emit and/or receive signals with a frequency higher than approximately 10 GHz. Such microwave circuits may include, for example, microwave transmitters, microwave receivers, microwave transceivers, microwave sensors, or microwave detectors. The RF devices described herein can be used for radar applications where the frequency of the RF signal can be modulated. Radar microwave devices can be used in automotive or industrial applications for distance determination/distance measurement systems, for example. For example, automatic vehicle speed control systems or vehicle anti-collision systems can operate in the microwave-frequency range, for example in frequency bands from 76 GHz to 77 GHz and from 77 GHz to 81 GHz.

Alternatively or additionally, the RF chip 4 can operate in a Bluetooth frequency range. Such a frequency range can include, for example, an ISM (Industrial, Scientific and Medical)-band between approximately 2.402 GHz and approximately 2.480 GHz. The RF chip 4 or integrated circuits in the RF chip 4 can therefore be designed more generally to operate in a frequency range higher than approximately 1 GHz, and the RF antenna 6 can therefore be designed to emit and/or receive signals with a frequency higher than approximately 1 GHz.

The RF chip 4 can be at least partially embedded in the encapsulation material 8. In the example of FIG. 1, the side faces of the RF chip 4 may be covered by the encapsulation material 8. In other examples, the top of the RF chip 4 may also be at least partially covered by the encapsulation material 8. In FIG. 1, an optional passivation layer 24 can also be arranged over the top sides of the RF chip 4 and the encapsulation material 8. The encapsulation material 8 can protect the RF chip 4 against external effects such as moisture, leakage currents, or mechanical shocks. For example, the encapsulation material 8 may contain at least one of a molding compound, a laminate, an epoxy, a filled epoxy, a glass fiber-filled epoxy, an imide, a thermoplastic, a thermosetting polymer, or a polymer mixture.

The redistribution layer 10 is represented only in a qualitative manner in the example of FIG. 1 for the sake of simplicity. The redistribution layer 10 can contain one or more conductor tracks in the form of metal layers or metal tracks, which can extend essentially parallel to the surface 16 of the semiconductor package 2. A plurality of dielectric layers can be arranged between the plurality of conductor tracks in order to electrically insulate the conductor tracks from one another. In addition, metal layers arranged on different planes can be electrically connected to each other using a plurality of through-hole connections (vias), for example. The conductor tracks of the redistribution layer 10 can perform the function of redistribution or interconnection, in order to electrically couple terminals of the RF chip 4 to the connecting elements 12.

In the example of FIG. 1, a redistribution layer 10 can be used to redistribute the terminals of the RF chip 4 over the connecting elements 12, which can be arranged outside the footprint of the RF chip 4, when viewed in the y-direction. An RF device with such a splaying of the chip terminals can be called a "fan-out" device or "fan-out" package. In the example of FIG. 1, the semiconductor package 2 can be a wafer-level package, which can be produced according to an eWLB (embedded Wafer Level Ball Grid Array) process. In this package type, due to the manufacturing process the undersides of the RF chip 4 and the redistribution layer 10 can lie in a common plane, e.g. they can be arranged coplanar (see FIG. 1). Alternatively, in the case of an eWLB semiconductor package, the undersides of the RF chip 4 and the encapsulation material 8 may be coplanar due to the manufacturing process. RF devices according to the disclosure are not limited to a specific semiconductor package type. Another example package type in an RF device according to the disclosure is shown and described in FIG. 9.

Each of the connecting elements 12 can be designed to inject an electrical or electromagnetic signal provided by the RF chip 4 into the circuit board 14, or vice versa. In the example of FIG. 1, the connecting elements 12 are shown as solder balls or solder depots. In other examples, the connecting elements 12 can be in the shape of pillars and made of copper or a copper alloy, for example. In the side view of FIG. 1, an example having six solder balls is shown. In other examples, the number of connecting elements 12 can be different, in particular larger.

The RF antenna 6 can be formed in the electrical redistribution layer 10, in particular in the form of one or more metallic layers. A more detailed example design of a possible RF antenna 6 is shown and described in FIG. 10. In the example of FIG. 1, the RF antenna 6 can be arranged on the underside of the semiconductor package 2, which faces the circuit board 14. The RF antenna 6 can be designed to emit RF signals in its longitudinal direction, e.g. in the x-direction. Thus, the RF antenna 6 can be designed to emit radiation into the waveguide structure 18 in the direction parallel to the surface 16 of the semiconductor package 2. The RF signals from the RF antenna 6 can be coupled wirelessly into the waveguide structure 18. An example of the emission of electromagnetic waves into the waveguide structure 18 using the RF antenna 6 is indicated in FIG. 1 by wavefronts 26. In the example of FIG. 1, the RF antenna 6 can be a transmitting antenna. In other examples, alternatively or in addition to its transmission property, the RF antenna 6 can be designed to operate as a receiving antenna, e.g. to receive signals via the waveguide structure 18 in the direction parallel to the surface 16 of the semiconductor package 2.

The RF antenna 6 can at least partially protrude into the waveguide structure 18. A dimension $x_1$ of the part of the RF antenna 6 that protrudes into the waveguide structure 18 can be in a range from approximately 0.5 mm to approximately 3.0 mm, more precisely from approximately 1.0 mm to approximately 2.5 mm, more precisely from approximately 1.5 mm to approximately 2.0 mm. The RF antenna 6 can be designed in particular to emit radiation centrally into the waveguide structure 18. A central irradiation can be provided in particular by a suitable relative arrangement of the RF antenna 6 and the waveguide structure 18.

In one example, the RF antenna 6 can comprise or correspond to a "single-ended" antenna. In another example, the RF antenna 6 can comprise or correspond to a differential antenna. A corresponding characteristic of the RF antenna 6 can depend in particular on an electrical field distribution in the waveguide structure 18. An example relationship between the antenna type and the electrical field distribution is described in FIG. 4. The RF antenna 6 can be electrically coupled to a channel or to a terminal of the RF chip 4 via the redistribution layer 10. The channel can be a transmitting and/or receiving channel, for example. In terms of its signal transmission, the channel of the RF chip 4 can differ from the RF antenna 6. For example, the channel of the RF chip 4 that is coupled to the RF antenna 6 can be a single-ended channel, while the RF antenna 6 may be designed as a differential channel. In such a case, the RF device 100 may have a unit that provides a suitable transition of the signals from the channel of the RF chip 4 to the RF antenna 6, for example, a suitable transition from a single-ended signal transmission to a differential signal transmission.

In the example of FIG. 1, the waveguide structure 18 can be designed as two parts. A first part of the waveguide structure 18 can comprise or correspond to the recess 20 in the circuit board 14. The inner walls of the recess 20 can be metallized, so that the recess 20 can have waveguide properties for the transmission of electromagnetic waves. In the example of FIG. 1, the waveguide structure 18 can have a rectangular opening cross-section in the x-direction, wherein a lower part of the cross-section can be formed by the recess 20. Examples of rectangular opening cross-sections are shown and described in FIGS. 2A and 2B. In other examples, the opening cross-section of the waveguide structure 18 can have a different shape, for example circular or elliptical.

The recess 20 can be formed by a suitable subtractive process in which material of the circuit board 14 is removed. The subtractive process can include at least one of milling, grinding, drilling, or punching. After completion of the subtractive process, the inner walls of the resulting recess 20 can be metallized easily and cost-effectively by using a suitable metallization process.

A second part of the waveguide structure 18 can comprise or correspond to the waveguide 22. For example, the waveguide 22 can be produced from a one-part waveguide with a rectangular opening cross-section, which is opened along a direction parallel to its central axis, e.g. in the x-direction. For example, the waveguide 22 can correspond to half of a one-part waveguide with a rectangular opening cross-section. The waveguide 22 can be positioned above the recess 20 in such a way that the waveguide structure 18 has a rectangular opening cross-section. The two-part waveguide structure 18 of FIG. 1 can thus have the same or similar properties with regard to the transmission of electromagnetic waves as a conventional (one-part) waveguide with a rectangular opening cross-section.

The waveguide 22 can be mechanically connected to the circuit board 14 using a suitable connection technology. For example, the connection technology can include at least one of adhesive bonding, screwing, riveting, welding, or soldering. In the example of FIG. 1, the waveguide 22 can terminate flush with the top of the semiconductor package 2. In other examples, a gap can be formed between the top of the semiconductor package 2 and the waveguide 22.

The waveguide 22 can be produced by a subtractive process, for example by at least one of milling, grinding, drilling, or punching. Alternatively, the waveguide 22 can be produced by an additive process, for example by at least one of injection molding or 3D printing. In one example, the waveguide 22 can comprise or correspond to a metal tube. The metal tube can be made of a metal or metal alloy, for example from copper and/or brass. In another example, the waveguide 22 can be fabricated from plastic, a ceramic material, and/or a dielectric material and have metalized inner walls. In particular, the waveguide 22 can be formed by an injection-molding plastic with metalized inner walls. In this case the material of the injection-molding plastic can correspond to at least one of the materials mentioned above for the encapsulation material 8.

The recess 20 and the waveguide 22 can form a cavity through which injected or irradiated RF signals can be transmitted. The cavity can be filled with air or gas, e.g. it does not contain any solid or liquid. In other words, the waveguide structure 18 can be a material-free waveguide. A dimension $\mathbf{1}_1$ of the cavity in the y-direction from the base surface of the recess 20 to the cover surface of the waveguide 22 is designated in FIG. 1 by the parameter $\mathbf{1}_1$. In one example, the recess 20 and the waveguide 22 can essentially have the same dimension $\mathbf{0.51}_1$ in the y-direction. The RF antenna 6 can be spaced apart from the top of the circuit board 14 by a distance $y_1$. In order to provide a central irradiation of the RF antenna 6 into the waveguide structure 18, in another example the dimension of the waveguide 22 in the y-direction may be slightly larger than the dimension of the recess 20 in the y-direction.

The waveguide structure 18 can be designed to transmit the signals irradiated into the RF antenna 6 to one or more other components, or vice versa. The other components can be arranged with the RF device 100 on the circuit board 14, for example. The other components may or may not be considered as part of the RF device 100. The other components can comprise at least one of a radiation element or another RF chip or semiconductor package. An example arrangement on a circuit board, with an example signal distribution using waveguide structures according to the disclosure, is shown and described in FIG. 11.

In conventional RF systems, a signal distribution on a circuit board can be provided by planar waveguides (microstrip conductor, coplanar waveguide, stripline, etc.). Such a signal distribution can be prone to losses, as part of the electromagnetic waves usually propagates in a substrate of the circuit board. To achieve low-loss distribution, it may be necessary to use RF substrates, which can be more expensive than standard circuit boards. In contrast, for a signal transmission in accordance with the disclosure, such expensive RF substrates can be eliminated. In other words, a surface of the circuit board 14 arranged underneath the waveguide structure 18 and facing the waveguide structure 18 can be free of radio-frequency conducting structures or an RF substrate.

In conventional signal transmission using planar waveguides, unwanted electromagnetic waves may occasionally be emitted by the planar waveguides. This can lead to crosstalk between conductors arranged a small distance away from each other. In order to prevent crosstalk, it may be necessary to provide large distances between the conductors or to prevent irradiation of the conductors by additional structures, for example, absorbers that cover the conductors. In contrast, in the case of a signal transmission in accordance with the disclosure, such additional structures can be eliminated.

Figure 2A:
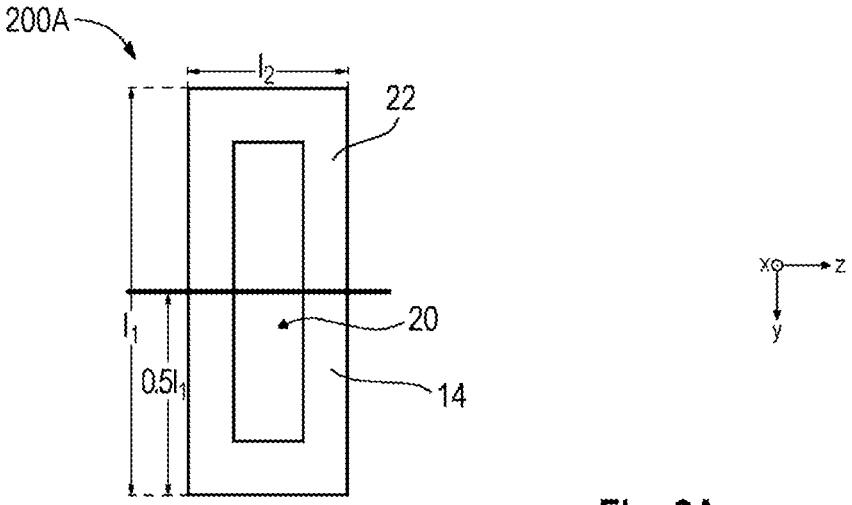
FIGS. 2A and 2B schematically illustrate cross-sectional side views of waveguide structures 200A and 200B according to the disclosure.
Figure 2B:
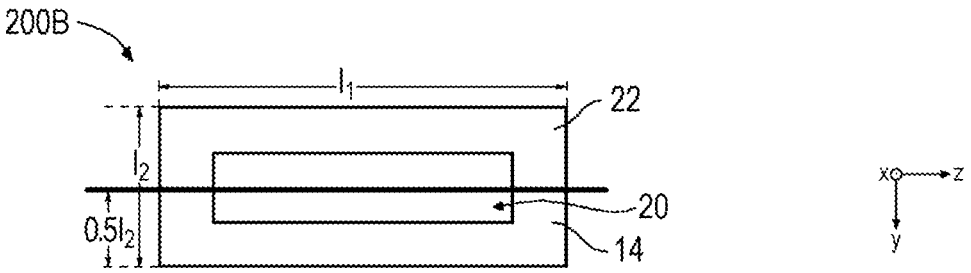

FIGS. 2A and 2B illustrate cross-sectional side views of waveguide structures 200A and 200B according to the disclosure. The waveguide structure 200A of FIG. 2A can be at least partially similar to the waveguide structure 18 of FIG. 1, in particular when viewed in the x-direction. The waveguide structure 200A can have a first part in the form of a waveguide 22. The waveguide 22 can be a waveguide which has been opened along a direction parallel to its central axis. In addition, the waveguide structure 200A may have a second part in the form of a recess 20 in a circuit board 14. A mechanical connection between the first and second parts of the waveguide structure 200A is indicated in FIGS. 2A and 2B by a line extending in the z-direction. The connected parts can form a rectangular opening cross-section.

The waveguide structure 200A can have a dimension $\mathbf{1}_1$ in the y-direction and a dimension $\mathbf{1}_2$ in the z-direction. In the example of FIG. 2A, the statement $\mathbf{1}_1 >> \mathbf{1}_2$ applies in particular. Thus, the longer rectangle side of the opening cross-section with the length $\mathbf{1}_1$ can extend in the y-direction, e.g. perpendicular to the surface of the semiconductor package (see FIG. 1). In the example of FIG. 2A, the first part and the second part can have an equal dimension of $0.51_1$ in the y-direction. In particular, an aspect ratio $\mathbf{1}_1/\mathbf{1}_2$ of the dimensions can have a value of 2:1. For example, an RF antenna radiating into the waveguide structure 200A can be arranged essentially at a height of the mechanical connection of the two parts. However, as described in connection with FIG. 1, there may be a small distance $y_1$ between the RF antenna and the top of the circuit board.

Compared to FIG. 2A, the waveguide structure 200B of FIG. 2B can be rotated by 90 degrees, so that the shorter rectangle side of the opening cross-section with length $\mathbf{1}_2$ can extend in the y-direction. Compared to FIG. 2A, the waveguide structure 200B may have an increased space in the x-z plane. Placing the waveguide structure "upright" as shown in FIG. 2A can thus represent a preferred implementation in order to save space in the x-z plane and thus enable as many channels of the RF chip to be used as possible (see FIG. 10).

In the examples of FIGS. 2A and 2B, in the case of a mechanical connection of the waveguide 22 to the circuit board 14, one or more electromagnetic matching structures (not shown) may be arranged. The electromagnetic matching structures can be designed, among other things, to prevent or attenuate any reflections which could impede optimal radiation of the RF antenna 6 into the waveguide structure 18. Using the electromagnetic matching structures can improve radiation from the RF antenna 6 into the waveguide structure 18, and losses during irradiation into the waveguide structure 18 can be prevented or at least reduced. In one example, the electromagnetic matching structures can comprise or correspond to one or more electromagnetic band gap (EBG) structures. An EBG structure may be designed to create a blocking range or blocking band (stop band), which can be designed to block electromagnetic waves of one or more frequency bands. For example, an EBG structure can be formed by a fine, periodic pattern of small metal platelets (metal patches) on a dielectric material.

Waveguide structures with rectangular opening cross-section (rectangular waveguides), such as those shown in FIGS. 2A and 2B, can comprise or correspond to a WRX (Waveguide Rectangular X) waveguide. In the WRX designation of the waveguide, the width of the waveguide can be expressed as a percentage of an inch (1 inch=25.4 mm). Thus, for example, a WR-28 waveguide can be 28% of an inch, e.g. 7.11 mm, wide. The value of X can be less than 100, more precisely less than 80, more precisely less than 70, more precisely less than 60, more precisely less than 50, more precisely less than 40, more precisely less than 30, more precisely less than 20, or more precisely less than 10. Selected examples of WRX waveguides with an X value of less than 100 are: WR90, WR75, WR62, WR51, WR42, WR34, WR28, WR22, WR19, WR15, WR10, WR8, WR6, WR5, WR4, WR3.

Figure 3:
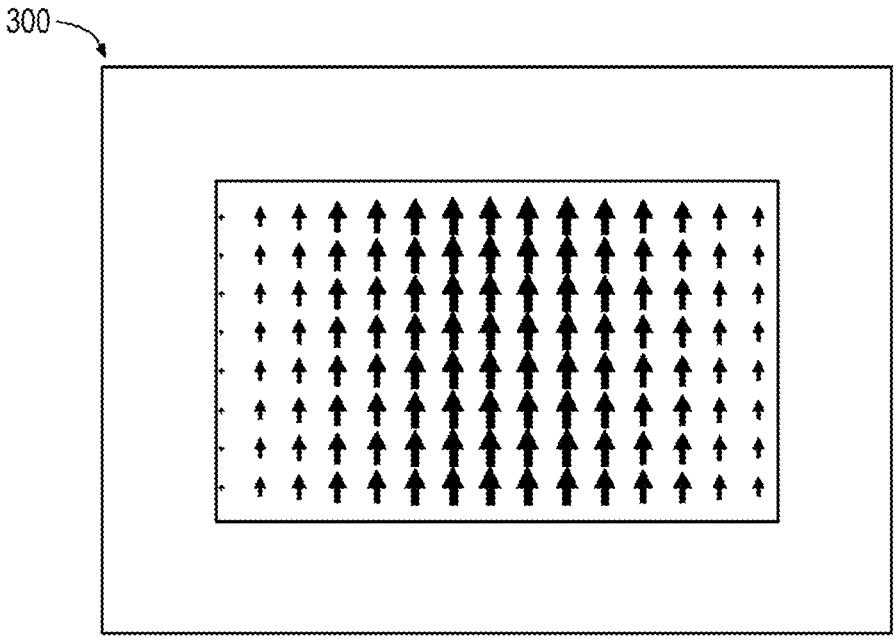
FIG. 3 illustrates a schematic, cross-sectional side view of an electric field distribution in a waveguide structure 300 according to the disclosure.
Figure 4:
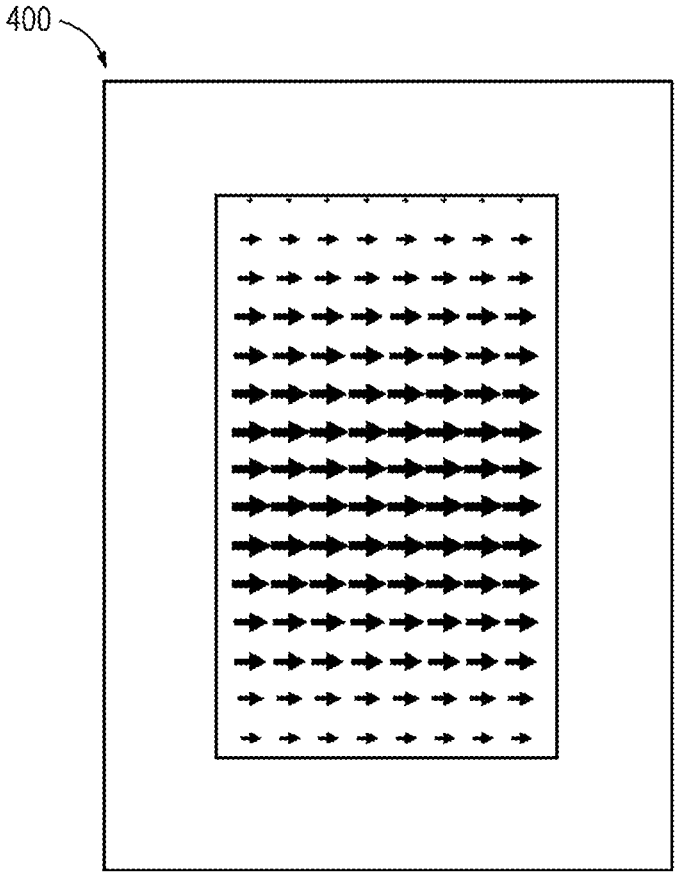
FIG. 4 illustrates a schematic, cross-sectional side view of an electric field distribution in a waveguide structure 400 according to the disclosure.

FIGS. 3 and 4 show schematic cross-sectional side views of electrical field distributions in waveguide structures 300 and 400 according to the disclosure. Here, the waveguide structures 300 ("horizontal waveguide") or 400 ("vertical waveguide") can be similar to the waveguide structures 200B or 200A of FIGS. 2A and 2B, for example. The electrical field strength is represented by arrows, where the size of an arrow can be considered proportional to the size of the electric field strength at the position of the arrow. The larger the arrow, the greater the electrical field strength. FIGS. 3 and 4 show in particular the distributions of the electric field in a dominant TE10 fundamental mode. The electrical field can have nodes or zeros on the inner faces of the waveguide with the shorter dimension, and can assume a maximum value in the middle between the the inner faces. Waveguide structures according to the disclosure can be designed to transmit a TE mode. In particular, the waveguide structures can be designed to transmit only a TE10 fundamental mode, but are by no means limited to that.

In particular, an RF antenna of an RF device according to the disclosure can be arranged in such a way that it radiates (essentially) centrally into the respective waveguide structure of FIGS. 3 and 4, e.g. at a maximum of the electrical field distribution. Referring back to FIG. 1, a differential RF antenna 6 can extend in a direction parallel to the surface 16 of the semiconductor package 2, e.g. in the x-direction. The major part of the electrical field of the signals emitted by the RF antenna 6 can be localized between the differential conductors or differential structures of the RF antenna 6 and point in the direction of the electrical field shown in FIG. 4. For this reason, when a waveguide according to FIG. 4 is used, a differential RF antenna extending in the x-direction may be particularly suitable for emitting radiation into the waveguide.

Figure 5A:
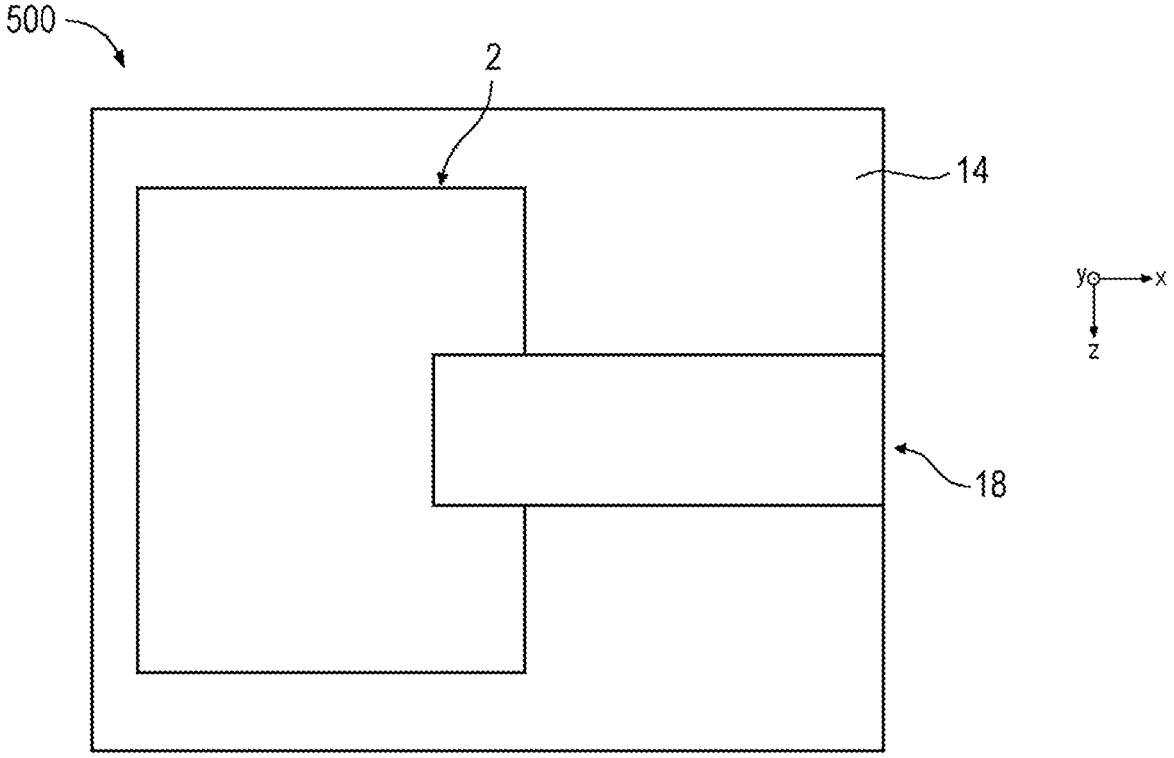
FIGS. 5A and 5B schematically illustrate a plan view and a cross-sectional side view of an RF device 500 according to the disclosure.
Figure 5B:
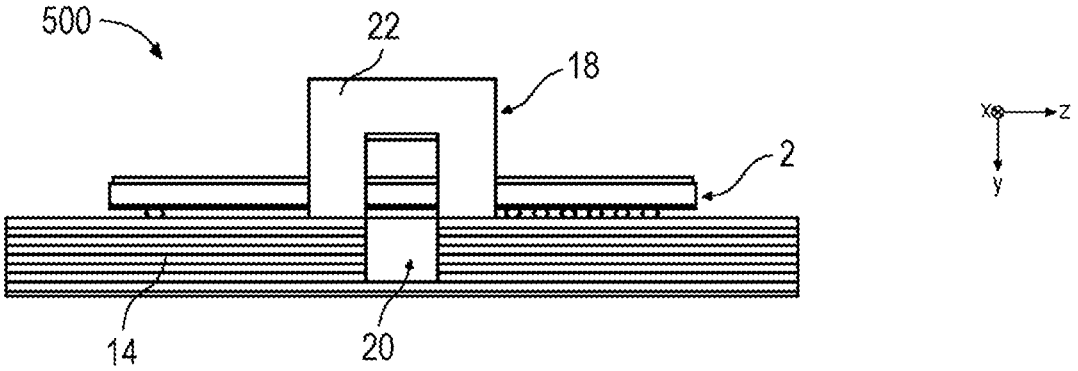

FIGS. 5A and 5B schematically illustrate a plan view and a cross-sectional side view of an RF device 500 according to the disclosure. The RF device 500 can be at least partially similar to the semiconductor device 100 of FIG. 1. The waveguide structure 18 of FIGS. 5A and 5B can be a "vertical" waveguide structure, e.g. the longer side of the rectangular waveguide cross-section can extend in the y-direction, as shown in the example of FIG. 2A. From the plan view of FIG. 5A it is clear that the waveguide structure 18 and the semiconductor package 2, viewed in a direction perpendicular to the surface of the semiconductor package, can at least partially overlap. Such an overlap can be provided in particular so that the RF antenna can at least partially protrude into the waveguide structure.

Figure 6A:
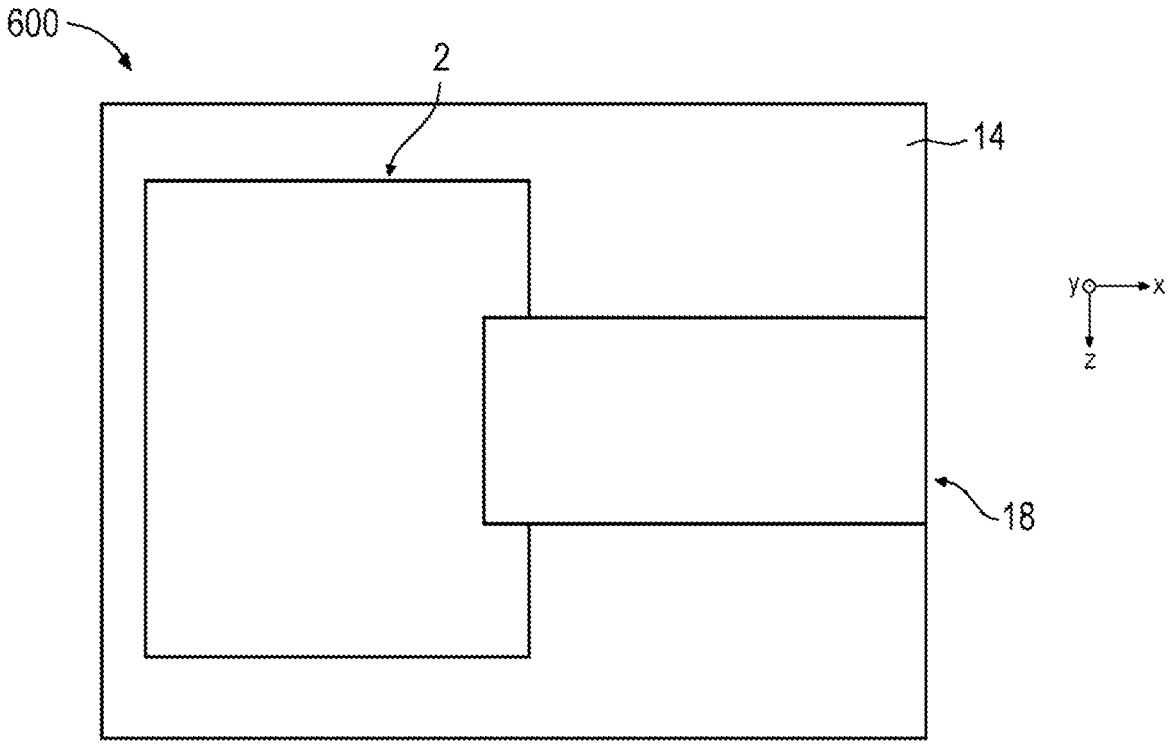
FIGS. 6A and 6B schematically illustrate a plan view and a cross-sectional side view of an RF device 600 according to the disclosure.
Figure 6B:
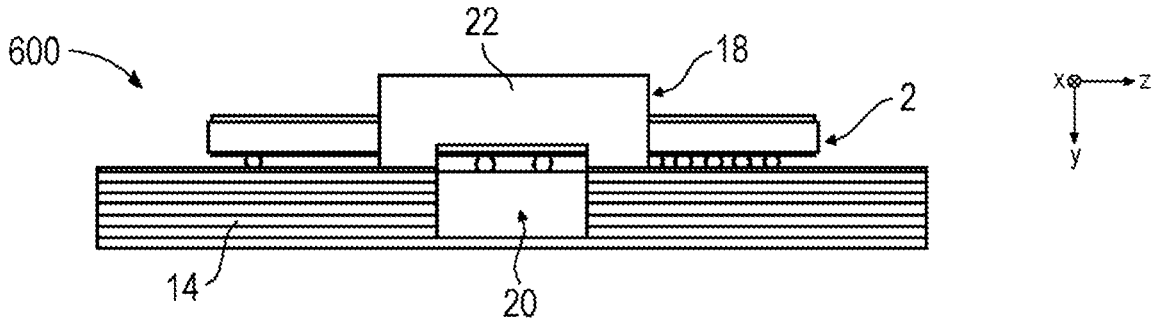

FIGS. 6A and 6B schematically illustrate a plan view and a cross-sectional side view of an RF device 600 according to the disclosure. The waveguide structure 18 of FIGS. 6A and 6B can be a "horizontal" waveguide structure, e.g. the longer side of the rectangular waveguide cross-section can extend in the z-direction, as shown in the example of FIG. 2B.

Figure 7:
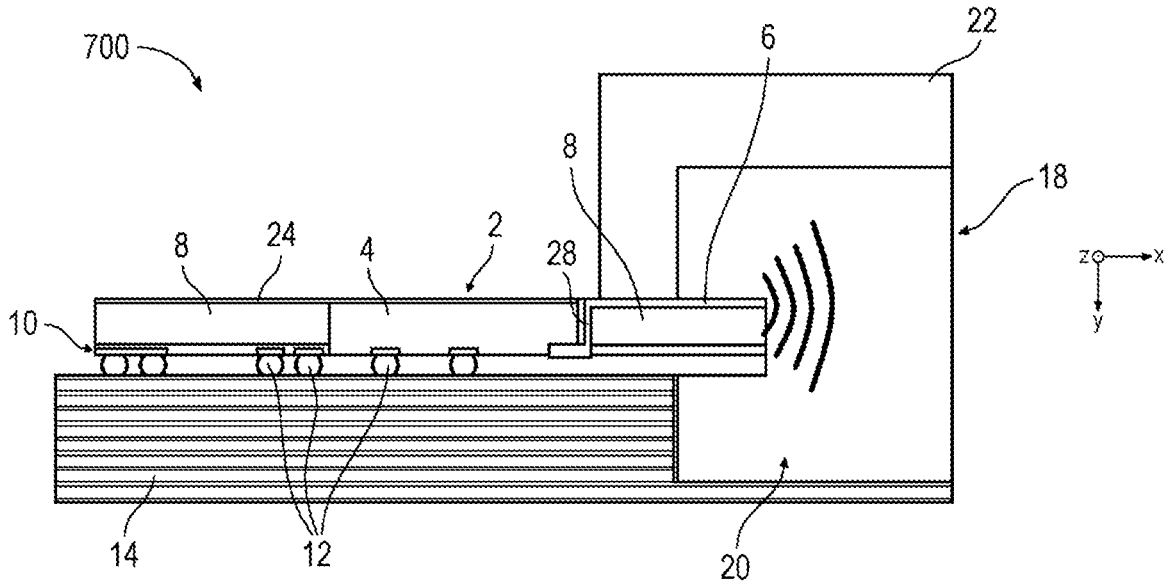
FIG. 7 illustrates a schematic, cross-sectional side view of an RF device 700 according to the disclosure.

FIG. 7 illustrates a schematic, cross-sectional side view of an RF device 700 as described in the disclosure. The RF device 700 can be at least partially similar to the RF device 100 of FIG. 1. In contrast to FIG. 1, the RF antenna 6 in FIG. 7 can be arranged on a surface of the semiconductor package 2 facing away from the circuit board 14. An electrical redistribution between a terminal of the RF chip 4 and the RF antenna 6 can be provided by an electrical through-hole contact 28 passing through the encapsulation material 8. In another example, the electrical through-hole contact 28 can be a via-connection. In another example, the electrical through-hole contact 28 can have one or more waveguides passing through the encapsulation material 8. On the top of the semiconductor package 2 a coupling structure (not shown) can be arranged, which is designed to inject a signal provided via the electrical through-hole contact 28 into the RF antenna 6 and/or vice versa. Such a coupling structure can contain, for example, one or more patch antennas.

Figure 8:
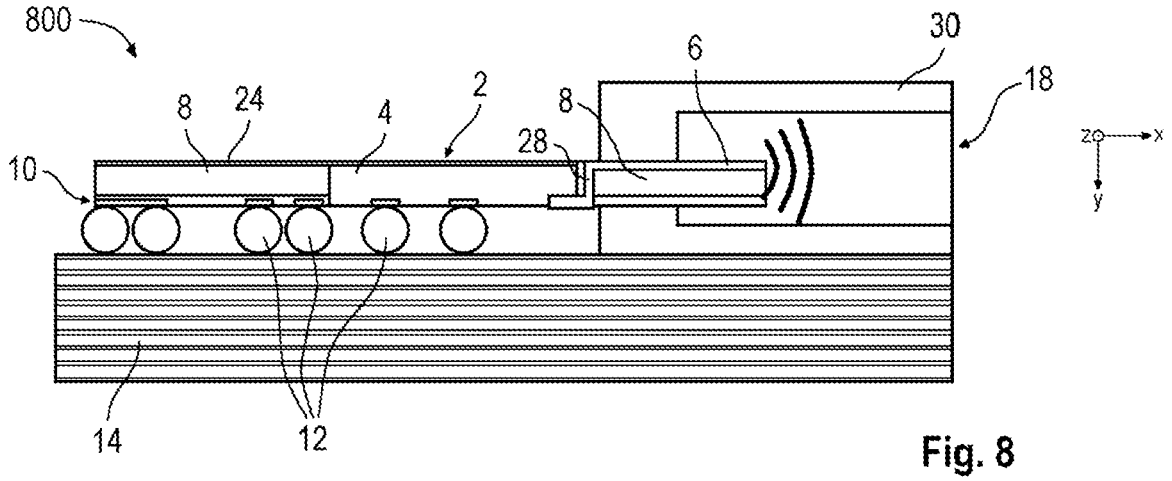
FIG. 8 illustrates a schematic, cross-sectional side view of an RF device 800 according to the disclosure.

FIG. 8 illustrates a schematic, cross-sectional side view of an RF device 800 according to the disclosure. The RF device 800 can be at least partially similar to the RF device 700 of FIG. 7. In contrast to FIG. 7, the waveguide structure 18 of the RF device 800 can be formed by a one-part waveguide 30, which can be arranged next to the semiconductor package 2 on the circuit board 14. Thus, a lower part of the waveguide structure 18 does not necessarily have to be formed by a recess 20 in the circuit board 14 with metalized inner walls, as shown by way of example in FIG. 1.

The waveguide 30 can be at least partially similar to the waveguide 22 of FIG. 1 and be produced in a similar way. In particular, the waveguide 30 can be at least partially formed by an injection-molding plastic with metallized inner walls. In contrast to the waveguide 22 of FIG. 1, the waveguide 30 is not opened along a direction parallel to its central axis. Viewed in the x-direction, the waveguide 30 can have a rectangular opening cross-section. In the example of FIG. 8, the top of the circuit board 14 can be essentially planar. In other examples, the top of the circuit board 14 can have a recess (not shown), in which the one-part waveguide 30 can be at least partially arranged. The use of such a recess allows a position of the waveguide 30 to be adjusted in the y-direction, in particular to provide a central irradiation of the RF antenna 6 into the waveguide 30.

Figure 9:
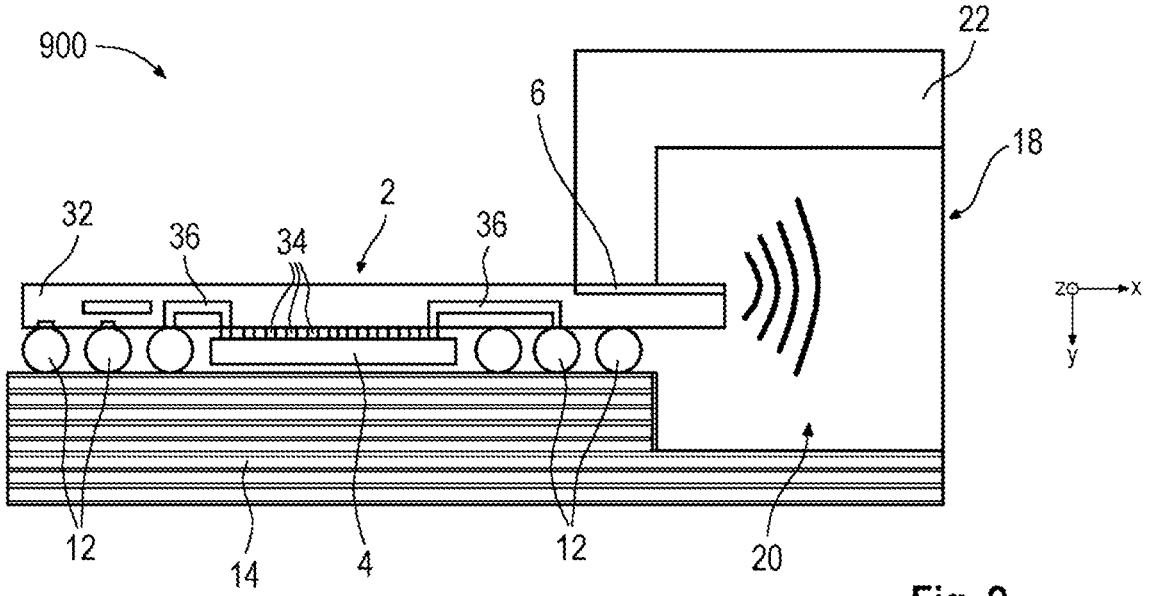
FIG. 9 illustrates a schematic, cross-sectional side view of an RF device 900 according to the disclosure.

FIG. 9 illustrates a schematic, cross-sectional side view of an RF device 900 according to the disclosure. The RF device 900 can be at least partially similar to the RF device 700 of FIG. 7. In contrast to FIG. 7, the RF device 900 of FIG. 9 can have a different semiconductor package type. For example, the semiconductor package 2 of FIG. 9 can be an FCBGA (Flip Chip Ball Grid Array). The semiconductor package 2 can have a substrate 32, which can be electrically and mechanically connected to the circuit board 14 via one or more connecting elements 12. The substrate 32 can be a BGA (Ball Grid Array) substrate, for example.

An RF chip 4 can be mounted on the substrate 32 using a flip-chip technique. The RF chip 4 can be electrically and mechanically connected to the substrate 32 via additional connection elements 34. Signal routing structures 36 arranged in the substrate 32 can electrically couple the connection elements 12 to the RF chip 4. On the top of the substrate 32, an RF antenna 6 can be arranged, which can be designed to emit radiation into the waveguide structure 18 in the x-direction. The RF chip 4 can be electrically coupled to the RF antenna 6 via the signal routing structures 36 and optional additional electrical redistribution structures (not shown), so that signals can be transmitted between the RF chip 4 and the RF antenna 6. An explicit coupling between the RF chip 4 and the RF antenna 6 is not shown in FIG. 9, for the sake of simplicity.

Figure 10:
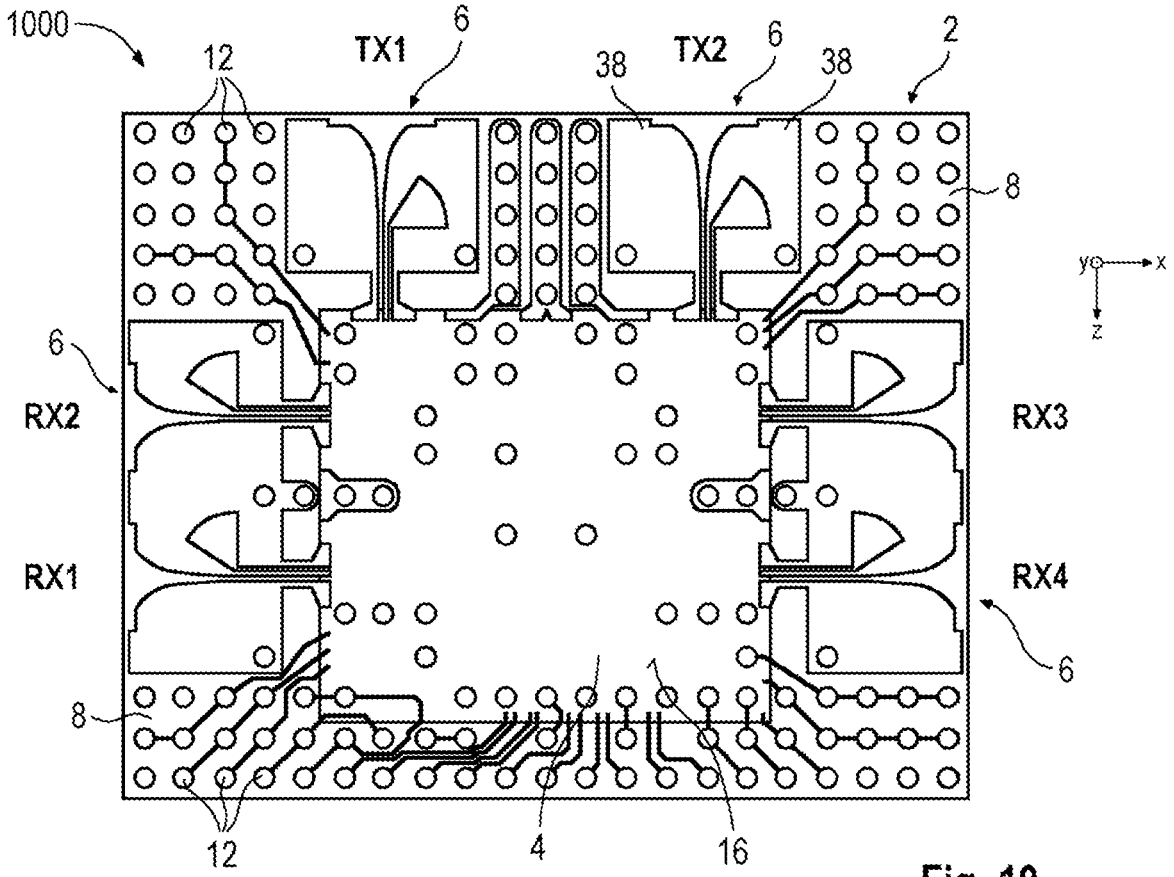
FIG. 10 illustrates a schematic, cross-sectional side view of an RF device 1000 according to the disclosure.

FIG. 10 illustrates a schematic, cross-sectional side view of an RF device 1000 according to the disclosure. The RF device 1000 can comprise a semiconductor package 2 and other components, which for the sake of simplicity are not shown in FIG. 10. The semiconductor package 2 can be at least partially similar to the semiconductor package 2 of FIG. 1. Referring to FIG. 1, FIG. 10 can display a view of the underside surface 16 of the semiconductor package 2.

The semiconductor package 2 can have an RF semiconductor chip 4 embedded in an encapsulation material 8. A plurality of connection elements 12 can be arranged on the underside surface 16 of the semiconductor package 2, at least some of which can be designed to electrically and mechanically connect the RF chip 4 to a circuit board (not shown). The RF chip 4 can have a plurality of channels, which can be assigned to corresponding terminals of the RF chip 4. In particular, the channels can be different from one another. In the example of FIG. 10, the RF chip 4 can have two transmitting channels TX1, TX2 and four receiving channels RX1-RX4. The terminals of the two transmitting channels TX1, TX2, the terminals of the two receiving channels RX1, RX2, and the terminals of the two receiving channels RX3, RX4 can be arranged on the same side of the RF chip 4. In other examples, the number of transmitting and/or receiving channels can be chosen differently. In general, a number of the transmitting channels and a number of the receiving channels can each be less than or equal to 6, more precisely less than or equal to 5, more precisely less than or equal to 4, more precisely less than or equal to 3, more precisely less than or equal to 2.

Each transmitting or receiving channel can be assigned an RF transmitting or receiving antenna 6, which can be electrically connected to corresponding terminals of the RF chip 4. The respective RF antenna 6 can comprise or correspond to a differential antenna. The width of the RF antenna 6 can increase in a direction parallel to the surface 16 of the semiconductor package 2. For example, the RF antenna 6 can be formed in a redistribution layer of the semiconductor package 2 and have two antenna vanes 38. In the plan view of FIG. 10, the geometric shape of the RF antenna 6 can be similar to the geometric shape of a Vivaldi antenna in a corresponding view. The RF antenna 6 may have a fanned structure in this view. In one example, the RF antenna 6 can in particular resemble or correspond to a Vivaldi antenna.

The RF device 1000 can comprise a plurality of waveguide structures, which for the sake of simplicity are not shown in FIG. 10. Each of the waveguide structures can be assigned to one of the RF antennas 6 and can be aligned relative to this RF antenna 6 as shown and described in FIG. 1, for example. Thus, an RF antenna 6 and a waveguide structure can be assigned to each channel of the RF chip 4. The RF transmitting antennas 6 can each be designed to radiate signals into the waveguide structures assigned to them, while the RF receiving antennas 6 can each be designed to receive signals via the waveguide structures assigned to them.

In conventional RF devices, signals from the RF chip can be transmitted into a waveguide upwards, e.g. in a direction perpendicular to the main surface of the semiconductor package. The waveguide can be arranged above the main surface of the semiconductor package and extend at least partially in the perpendicular direction. In conventional RF devices, due to space limitations it can be difficult to separate different channels of the RF chip and to irradiate them into different waveguides. As a rule, only one signal can be transmitted with these RF devices. In contrast, using a sideways or lateral irradiation into the waveguide structure according to the disclosure, a separation of the different channels of the RF chip can be provided and multiple channels of the RF chip can be used. In order to save space and to be able to use as many channels of the RF chip as possible, when designing RF devices according to the disclosure, in particular "vertical" waveguide structures can be used, as shown in the examples of FIGS. 2A and 4.

Figure 11:
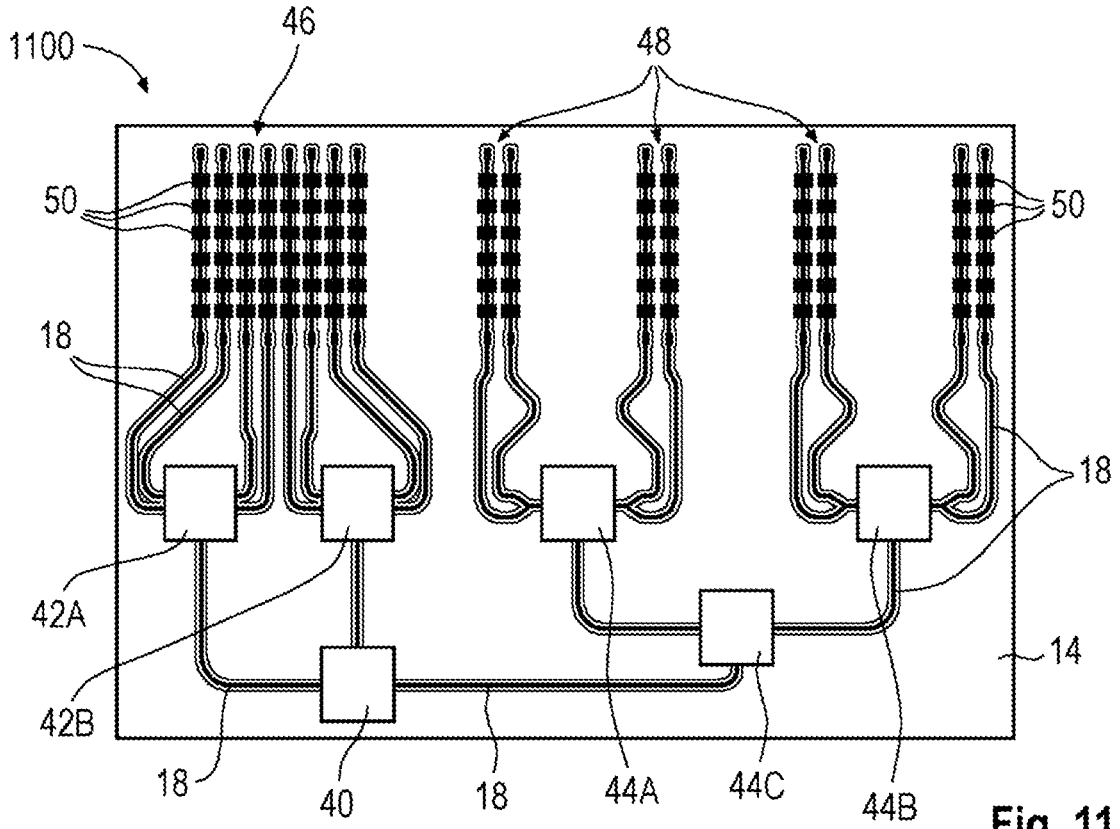
FIG. 11 illustrates a schematic RF system 1100 having RF devices according to the disclosure.

FIG. 11 illustrates a schematic RF system 1100, which can comprise one or more RF devices according to the disclosure. In particular, FIG. 11 shows an example distribution of RF signals between the components of the RF system 1100.

The RF system 1100 can comprise a local oscillator (LO) circuit 40, a plurality of receiving circuits 42A, 42B and a plurality of transmitting circuits 44A-44C. One or more of the receiving circuits 42 and/or the transmitting circuits 44 may be designed in the form of RF devices according to the disclosure. The LO circuit 40 can be designed to provide a radio-frequency LO signal to the receiving circuits 42 and/or the transmitting circuits 44. The RF system 1100 can also have receiving antenna elements 46 or transmitting antenna elements 48. The antenna elements 46 or 48 can be designed in particular to receive or transmit RF signals. In the example of FIG. 11, one or more of the antenna elements 46, 48 may be designed in the form of a plurality of conductive patches (or patch antennas) 50, which can be electrically connected, in particular in the form of a patch column or a patch branch. The components of the RF system 1100 can be arranged on a circuit board 14 and connected by waveguide structures 18 according to the disclosure.

The waveguide structures 18 can be used, for example, to transmit RF signals between the components of the RF system 1100. For example, the transmitting circuit 44C can receive a radio-frequency LO signal from the LO circuit 40 via a waveguide structure 18. By using the waveguide structures 18 according to the disclosure, it is possible to avoid crosstalk between closely spaced signal paths. In addition, all components of the RF system 1100 can be mounted on a standard circuit board, without the need to use an expensive RF substrate. In addition, a plurality of the channels of the RF chip contained in the respective circuit can be used.

Figure 12:
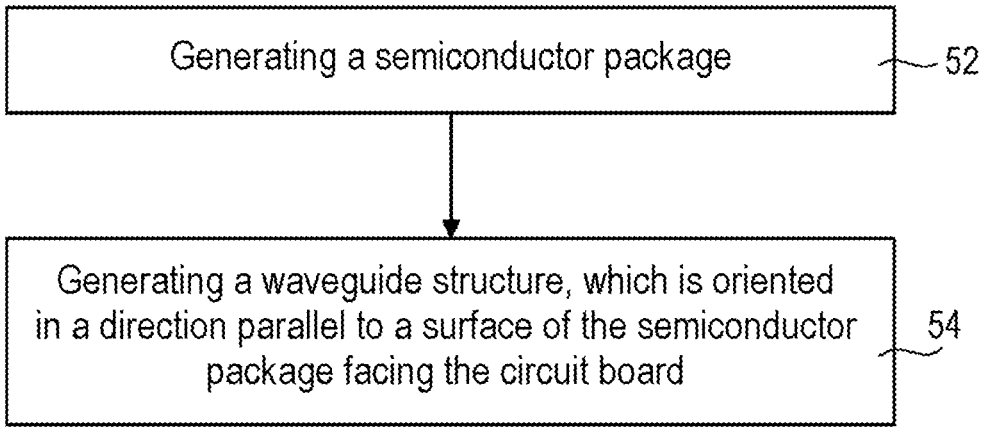
FIG. 12 shows a flowchart of a method for producing an RF device according to the disclosure.

FIG. 12 shows a flowchart of a method for producing an RF device according to the disclosure. The method can be used to produce any of the RF devices described above. The method is presented in a general manner, in order to describe aspects of the disclosure in qualitative terms. The method may be extended by one or more aspects described in conjunction with the examples according to the disclosure described above.

In 52, a semiconductor package can be generated which can contain an RF chip and an RF antenna. The semiconductor package can be designed to be mechanically and electrically connected to a circuit board via at least one connecting element of the semiconductor package, with one surface of the semiconductor package facing the circuit board. In 54 a waveguide structure can be generated, which is oriented in a direction parallel to the surface of the semiconductor package. The RF antenna can be designed for at least one of the following: to emit radiation into the waveguide structure in the direction parallel to the surface of the semiconductor package, or to receive signals via the waveguide structure in the direction parallel to the surface of the semiconductor package.

EXAMPLES

In the following text, RF devices with RF chip and waveguide structure as well as associated production processes are explained using examples.

Example 1 is a radio-frequency device, comprising: a semiconductor package, comprising: a radio-frequency chip and a radio-frequency antenna, wherein the semiconductor package is designed to be mechanically and electrically connected to a circuit board via at least one connecting element of the semiconductor package, with one surface of the semiconductor package facing the circuit board; and a waveguide structure oriented in a direction parallel to the surface of the semiconductor package, the radio-frequency antenna being designed for at least one of the following: to emit radiation into the waveguide structure in the direction parallel to the surface of the semiconductor package, or to receive signals via the waveguide structure in the direction parallel to the surface of the semiconductor package.

Example 2 is a radio-frequency device according to example 1, wherein the waveguide structure has a recess with metallized inner walls formed in the circuit board.

Example 3 is a radio-frequency device according to example 2, wherein: a first part of the waveguide structure comprises the recess in the circuit board, and a second part of the waveguide structure comprises a waveguide which is open along a direction parallel to its central axis and is arranged above the recess.

Example 4 is a radio-frequency device according to example 3, wherein the first part of the waveguide structure and the second part of the waveguide structure essentially have an identical measurement in a direction perpendicular to the surface of the semiconductor package.

Example 5 is a radio-frequency device according to example 3 or 4, wherein when a mechanical connection is made between the first part and the second part an electromagnetic matching structure is arranged.

Example 6 is a radio-frequency device according to example 1, wherein the waveguide structure is formed by a one-part waveguide, which is arranged next to the semiconductor package on the circuit board.

Example 7 is a radio-frequency device according to one of the preceding examples, wherein the waveguide structure is at least partially formed by an injection-molded plastic with metallized inner walls.

Example 8 is a radio-frequency device according to one of the preceding examples, wherein: an opening cross-section of the waveguide structure is rectangular, and a longer rectangle side of the opening cross-section extends in a direction perpendicular to the surface of the semiconductor package.

Example 9 is a radio-frequency device according to one of the preceding examples, wherein the radio-frequency antenna protrudes at least partially into the waveguide structure.

Example 10 is a radio-frequency device according to one of the preceding examples, wherein the radio-frequency antenna is designed to emit radiation centrally into the waveguide structure.

Example 11 is a radio-frequency device according to one of the preceding examples, wherein the radio-frequency antenna is arranged on a surface of the semiconductor package facing the circuit board or on a surface of the semiconductor package facing away from the circuit board.

Example 12 is a radio-frequency device according to one of the preceding examples, wherein the semiconductor package also comprises: an electrical redistribution layer, wherein the radio-frequency antenna is formed in the electrical redistribution layer.

Example 13 is a radio-frequency device according to one of the preceding examples, wherein the radio-frequency antenna comprises a differential antenna, the width of which increases in a direction parallel to the surface of the semiconductor package.

Example 14 is a radio-frequency device according to one of the preceding examples, wherein: the semiconductor package comprises at least one additional radio-frequency antenna, the radio-frequency device comprises at least one additional waveguide structure which is oriented in a direction parallel to the surface of the semiconductor package, the additional radio-frequency antenna is designed for at least one of the following: to emit radiation into the additional waveguide structure in the direction parallel to the surface of the semiconductor package, or to receive signals in the direction parallel to the surface of the semiconductor package via the waveguide structure, the radio-frequency antenna and the waveguide structure are assigned to a channel of the radio-frequency chip, the additional radio-frequency antenna and the additional waveguide structure are assigned to an additional channel of the radio-frequency chip, and the channel and the additional channel are different to each other.

Example 15 is a radio-frequency device according to one of the preceding examples, wherein the waveguide structure is designed for at least one of the following: to transmit signals from the radio-frequency antenna to at least one of a radiation element or an additional radio-frequency chip, or to transmit signals to the radio-frequency antenna from at least one of a radiation element or an additional radio-frequency chip.

Example 16 is a radio-frequency device according to one of the preceding examples, wherein the semiconductor package also comprises: a substrate, wherein the radio-frequency chip is mounted on the substrate using a flip-chip technology, and wherein the substrate is connected to the circuit board via the connecting element.

Example 17 is a radio-frequency device according to one of the examples 1 to 15, wherein the semiconductor package also comprises: an encapsulation material, wherein the radio-frequency chip is at least partially encapsulated by the encapsulation material, wherein a surface of the encapsulation material and a surface of the radio-frequency chip lie in a plane.

Example 18 is a radio-frequency device according to one of the preceding examples, wherein the waveguide structure and the semiconductor package, viewed in a direction perpendicular to the surface of the semiconductor package, at least partially overlap.

Example 19 is a radio-frequency device according to one of the preceding examples, wherein the waveguide structure is designed to transmit a TE mode.

Example 20 is a radio-frequency device according to example 19, wherein the waveguide structure is designed to exclusively transmit a TE10 fundamental mode.

Example 21 is a radio-frequency device according to one of the preceding examples, wherein the waveguide structure comprises a WRX waveguide, where X is less than 100.

Example 22 is a method for producing a radio-frequency device, the method comprising: generating a semiconductor package, comprising: a radio-frequency chip, and a radio-frequency antenna, wherein the semiconductor package is designed to be mechanically and electrically connected to a circuit board via at least one connecting element of the semiconductor package, with one surface of the semiconductor package facing the circuit board; and generating a waveguide structure oriented in a direction parallel to the surface of the semiconductor package, the radio-frequency antenna being designed for at least one of the following: to emit radiation into the waveguide structure in the direction parallel to the surface of the semiconductor package, or to receive signals via the waveguide structure in the direction parallel to the surface of the semiconductor package.

For the purposes of this description, the terms "connected", "coupled", "electrically connected" and/or "electrically coupled" do not necessarily mean that components must be directly connected or coupled together. There may be intermediate components present between the "connected", "coupled", "electrically connected" or "electrically coupled" components.

In addition, the words "above" and "on", which are used, for example, with reference to a layer of material that is formed "above" or "on" a surface of an object or is located "above" or "on" it, may be used in the present description in the sense that the material layer is arranged (for example, formed, deposited, etc.) "directly on", for example in direct contact with, the intended surface. The words "above" and "on", which are used, for example, with reference to a layer of material that is formed or arranged "above" or "on" a surface, may also be used in the present text in the sense that the material layer is arranged (e.g. formed, deposited, etc.) "indirectly on" the intended surface, in which case, for example, one or more additional layers are located between the intended surface and the material layer.

Where the terms "have", "contain", "possess", "with" or variants thereof are used either in the detailed description or the claims, these terms shall be meant inclusively in a manner similar to the term "comprise". This means that, for the purposes of this description, the terms "have", "contain", "possess", "with", "comprise" and the like are open terms that indicate the presence of the elements or features but do not exclude further elements or features. The articles "a/an" or "the" are to be understood in such a way as to include both the plural meaning as well as the singular meaning, unless the context clearly suggests a different interpretation.

In addition, the word "exemplary" is used in the present text in the sense that it serves as an example, a case or an illustration. An aspect or a design that is described as "exemplary" in the present text is not necessarily to be understood as having advantages over other aspects or designs. Rather, the use of the word "exemplary" is intended to represent concepts in a concrete way. For the purposes of this application, the term "or" does not mean an exclusive "or", but an inclusive "or". That is, unless otherwise stated or if the context does not permit any other interpretation, the phrase "X uses A or B" means any of the natural inclusive permutations. That is, if X uses A, X uses B, or X uses both A and B, then "X uses A or B" is satisfied in each of the above cases. In addition, the articles "a/an" for the purposes of this application and the accompanying claims may be interpreted generally as "one or more", unless it is expressly stated or can be clearly understood from the context that only the singular is meant. In addition, at least one of A and B or the like generally means A or B or both A and B.

In the present description, devices and methods for producing devices are described. Comments made in conjunction with a described device may also apply to a corresponding method, and vice versa. For example, if a particular component of a device is described, a corresponding method for producing the device may contain an action to provide the component in an appropriate manner, even if such an action is not explicitly described or illustrated in the figures. In addition, the features of the various example aspects described in the present text may be combined, unless expressly stated otherwise.

Although the disclosure has been shown and described with reference to one or more implementations, the person skilled in the art will imagine equivalent variations and modifications which are at least partly based on the reading and understanding of this description and the accompanying drawings. The disclosure includes all such variations and modifications and is limited solely by the concept of the following claims. Specifically, with regard to the various functions performed by the components described above (for example, elements, resources, etc.), it is intended that, unless otherwise specified, the terms used to describe such components shall correspond to any component that performs the specified function of the component described (which is functionally equivalent, for example), even if it is not structurally equivalent to the disclosed structure that performs the function of the example implementations of the disclosure presented herein. Furthermore, even if a particular feature of the disclosure has been disclosed with reference to only one of various implementations, such a feature may be combined with one or more other features of the other implementations in a way that is desirable and advantageous for a given or specific application.

The invention claimed is:

1. A radio-frequency device, comprising:

a semiconductor package, comprising:

a radio-frequency chip, and a radio-frequency antenna, wherein the semiconductor package is configured to be mechanically and electrically connected to a circuit board via at least one connecting element of the semiconductor package, with a surface of the semiconductor package facing the circuit board; and a waveguide structure oriented in a direction parallel to the surface of the semiconductor package, wherein the radio-frequency antenna is configured to at least one of:

emit radiation into the waveguide structure in the direction parallel to the surface of the semiconductor package, or receive signals via the waveguide structure in the direction parallel to the surface of the semiconductor package.

2. The radio-frequency device as claimed in claim 1, wherein the waveguide structure has a recess with metallized inner walls formed in the circuit board.

3. The radio-frequency device as claimed in claim 2, wherein:

a first part of the waveguide structure comprises the recess in the circuit board, and a second part of the waveguide structure comprises a waveguide which is open along a direction parallel to its central axis and is arranged above the recess.

4. The radio-frequency device as claimed in claim 3, wherein the first part of the waveguide structure and the second part of the waveguide structure essentially have an identical measurement in a direction perpendicular to the surface of the semiconductor package.

5. The radio-frequency device as claimed in claim 3, wherein when a mechanical connection is made between the first part and the second part, an electromagnetic matching structure is arranged.

6. The radio-frequency device as claimed in claim 1, wherein the waveguide structure is formed by a one-part waveguide, which is arranged next to the semiconductor package on the circuit board.

7. The radio-frequency device as claimed in claim 1, wherein the waveguide structure is at least partially formed by an injection-molded plastic with metallized inner walls.

8. The radio-frequency device as claimed in claim 1, wherein:

an opening cross-section of the waveguide structure is rectangular, and a longer rectangle side of the opening cross-section extends in a direction perpendicular to the surface of the semiconductor package.

9. The radio-frequency device as claimed in claim 1, wherein the radio-frequency antenna protrudes at least partially into the waveguide structure.

10. The radio-frequency device as claimed in claim 1, wherein the radio-frequency antenna is configured to emit radiation centrally into the waveguide structure.

11. The radio-frequency device as claimed in claim 1, wherein the radio-frequency antenna is arranged on a surface of the semiconductor package facing the circuit board, or on a surface of the semiconductor package facing away from the circuit board.

12. The radio-frequency device as claimed in claim 1, the semiconductor package further comprising:

an electrical redistribution layer, wherein the radio-frequency antenna is formed in the electrical redistribution layer.

13. The radio-frequency device as claimed in claim 1, wherein the radio-frequency antenna comprises a differential antenna, a width of which increases in a direction parallel to the surface of the semiconductor package.

14. The radio-frequency device as claimed in claim 1, wherein:

the semiconductor package comprises at least one additional radio-frequency antenna, the radio-frequency device comprises at least one additional waveguide structure, which is aligned in a direction parallel to the surface of the semiconductor package, the additional radio-frequency antenna is configured to at least one of:

emit radiation into the additional waveguide structure in the direction parallel to the surface of the semiconductor package, or receive signals via the waveguide structure in the direction parallel to the surface of the semiconductor package, the radio-frequency antenna and the waveguide structure are assigned to a channel of the radio-frequency chip, the additional radio-frequency antenna and the additional waveguide structure are assigned to an additional channel of the radio-frequency chip, and the channel and the additional channel are different.

15. The radio-frequency device as claimed in claim 1, wherein the waveguide structure is configured to at least one of:

transmit signals from the radio-frequency antenna to at least one of a radiation element or an additional radio-frequency chip, or transmit signals to the radio-frequency antenna from at least one of a radiation element or additional radio-frequency chip.

16. The radio-frequency device as claimed in claim 1, the semiconductor package further comprising:

a substrate, wherein the radio-frequency chip is mounted on the substrate by means of a flip-chip technique, and the substrate is connected to the circuit board via the at least one connecting element.

17. The radio-frequency device as claimed in claim 1, the semiconductor package further comprising:

an encapsulation material, wherein the radio-frequency chip is at least partially encapsulated by the encapsulation material, and wherein a surface of the encapsulation material and a surface of the radio-frequency chip lie in a plane.

18. The radio-frequency device as claimed in claim 1, wherein the waveguide structure and the semiconductor package, viewed in a direction perpendicular to the surface of the semiconductor package, at least partially overlap.

19. The radio-frequency device as claimed in claim 1, wherein the waveguide structure is configured to transmit a TE-mode.

20. The radio-frequency device as claimed in claim 19, wherein the waveguide structure is configured to exclusively transmit a TE10 fundamental mode.

21. The radio-frequency device as claimed in claim 1, wherein the waveguide structure comprises a WRX-waveguide, where X is less than 100.

22. A method for producing a radio-frequency device, the method comprising:

generating a semiconductor package, comprising:

a radio-frequency chip, and a radio-frequency antenna, wherein the semiconductor package is configured to be mechanically and electrically connected to a circuit board via at least one connecting element of the semiconductor package, with a surface of the semiconductor package facing the circuit board; and generating a waveguide structure oriented in a direction parallel to the surface of the semiconductor package, wherein the radio-frequency antenna is configured to at least one of:

emit radiation into the waveguide structure in the direction parallel to the surface of the semiconductor package, or receive signals via the waveguide structure in the direction parallel to the surface of the semiconductor package.

* * * * *